US010165881B2

(12) United States Patent
Marciano

(10) Patent No.: US 10,165,881 B2
(45) Date of Patent: Jan. 1, 2019

(54) SELF LEVELING SPOON

(71) Applicant: ELI—EQUIPMENTS FOR LIFE IMPROVEMENT LTD., Netanya (IL)

(72) Inventor: Franck Marciano, Netanya (IL)

(73) Assignee: ELI—EQUIPMENTS FOR LIFE IMPROVEMENT LTD, Netanya (IL)

( * ) Notice: Subject to any disclaimer, the term of this patent is extended or adjusted under 35 U.S.C. 154(b) by 33 days.

(21) Appl. No.: 15/107,527

(22) PCT Filed: Dec. 30, 2014

(86) PCT No.: PCT/IL2014/051137
§ 371 (c)(1),
(2) Date: Jun. 23, 2016

(87) PCT Pub. No.: WO2015/101985
PCT Pub. Date: Jul. 9, 2015

(65) Prior Publication Data

US 2016/0316948 A1 Nov. 3, 2016

Related U.S. Application Data

(60) Provisional application No. 61/922,886, filed on Jan. 2, 2014.

(51) Int. Cl.

| | |
|---|---|
| ***A47J 43/28*** | (2006.01) |
| ***A47G 21/04*** | (2006.01) |
| ***A47G 21/02*** | (2006.01) |
| ***A47G 21/08*** | (2006.01) |

(52) U.S. Cl.
CPC ..... *A47G 21/04* (2013.01); *A47G 21/02* (2013.01); *A47G 21/08* (2013.01); *A47G 2400/086* (2013.01)

(58) Field of Classification Search
CPC ..... A47G 21/04; A47G 21/08; A47G 21/102; A47G 2400/086
USPC ..... 30/327
See application file for complete search history.

(56) References Cited

U.S. PATENT DOCUMENTS

| | | | | |
|---|---|---|---|---|
| 2,636,266 A | | 4/1953 | Sweet | |
| 3,492,039 A | | 1/1970 | Chmela | |
| 4,028,803 A | * | 6/1977 | Currie | A47G 21/02 16/430 |
| 4,389,777 A | * | 6/1983 | Landsberger | B25G 1/10 30/324 |
| 659,341 A | | 10/1990 | Dodd et al. | |

(Continued)

FOREIGN PATENT DOCUMENTS

| | | |
|---|---|---|
| CA | 2729354 | 1/2011 |
| CN | 101642355 | 5/2009 |

(Continued)

*Primary Examiner* — Ghassem Alie
*Assistant Examiner* — Bharat C Patel
(74) *Attorney, Agent, or Firm* — Soroker Agmon Nordman

(57) ABSTRACT

A spoon, including a handle portion and a utensil portion rotatably coupled to the handle portion. The handle portion includes an elongated rod having a top end and a bottom end. The elongated rod is rotatably coupled to the utensil portion at the top end; and a sleeve rotatably enclosing the elongated rod; The utensil portion includes a bowl for transferring content and a weight for balancing the bowl. The bowl is balanced to remain level in two orthogonal directions during use of the spoon.

14 Claims, 7 Drawing Sheets

(56) References Cited

U.S. PATENT DOCUMENTS

| | | | | |
|---|---|---|---|---|
| 4,993,156 | A * | 2/1991 | Craven | A01B 1/22 30/142 |
| 5,592,744 | A * | 1/1997 | Weinstein | A47G 21/02 30/324 |
| 5,630,276 | A * | 5/1997 | Weinstein | A47G 21/02 30/324 |
| 5,943,925 | A * | 8/1999 | Huang | B25G 1/007 81/177.1 |
| 6,349,620 | B1 * | 2/2002 | Anderson | B25G 1/007 81/177.9 |
| 6,393,704 | B1 * | 5/2002 | Tompkins | A47G 21/04 30/324 |
| 7,178,247 | B2 * | 2/2007 | Currie | A47G 21/02 16/110.1 |
| 7,416,377 | B2 | 8/2008 | Currie | |
| 8,230,603 | B2 | 7/2012 | Currie | |
| 8,348,316 | B2 | 1/2013 | Hemmings | |
| 2002/0166242 | A1 | 11/2002 | Huang | |
| 2003/0034662 | A1 | 2/2003 | Wilson | |
| 2006/0288589 | A1 * | 12/2006 | Verona | A47G 21/02 30/324 |
| 2008/0030034 | A1 | 2/2008 | Balaciano | |
| 2008/0178471 | A1 * | 7/2008 | Rosario-Solis | A47G 21/08 30/122 |
| 2009/0133940 | A1 | 5/2009 | Woods | |
| 2012/0017775 | A1 | 1/2012 | Sargent, III | |
| 2014/0052275 | A1 * | 2/2014 | Pathak | A61F 4/00 623/65 |

FOREIGN PATENT DOCUMENTS

| | | | |
|---|---|---|---|
| CN | 101849757 | | 9/2009 |
| CN | 202168691 | | 7/2011 |
| CN | 202874841 | | 11/2012 |
| EP | 413860 | A1 | 2/1991 |
| EP | 3089631 | | 11/2016 |
| FR | 1175905 | A | 4/1959 |
| FR | 2640130 | | 12/1988 |
| JP | H10192165 | | 1/1997 |
| JP | 2002315680 | | 4/2001 |
| JP | 2006006587 | | 6/2004 |
| JP | 2010094234 | | 10/2008 |
| KR | 20090122785 | A | 12/2009 |
| WO | 2008065283 | | 6/2006 |
| WO | 20120055779 | | 10/2011 |

* cited by examiner 140
170
120
150

160
150
140
IIIC
IIIC
110
120
180
190

160
150
140
170
110
120
180
190

SELF LEVELING SPOON

TECHNICAL FIELD

The present disclosure relates generally to a spoon for use by people with impaired coordination, and more specifically to a spoon that is self leveling in two orthogonal directions.

BACKGROUND

People with impaired coordination of their hands, for example infants, stroke victims and people that suffer from Cerebral Palsy (CP), typically have problems using eating utensils especially spoons. They generally find it hard to move the food from a plate to their mouth without spilling the contents of the spoon on the way. Additionally, they also have a hard time getting the food on the plate into the spoon.

SUMMARY

An aspect of an embodiment of the disclosure relates to a spoon with a bowl that remains level in two orthogonal directions so that a user can rotate the handle of the spoon or tilt the handle while the bowl of the spoon remains level.

In an exemplary embodiment of the disclosure, the spoon includes a handle portion and a utensil portion. The handle portion includes an rod having as top end and a bottom end, wherein the elongated rod is rotatably coupled to the utensil portion at the top end. The handle portion further includes a sleeve rotatably enclosing the rod so that a user can grasp the sleeve while the rod is free to rotate. Optionally, the sleeve is held in place by a screw connected to an end of the rod or the end of the rod includes means to prevent the sleeve form sliding off, for example a clip extending from the rod. Alternatively, the bottom end of the rod includes an extension that prevents the sleeve from falling off.

The utensil portion includes a bowl for transferring food or other content, a weight for balancing the bowl, and a connection interface such as wings to grasp the rod or shoulders that support a shaft to rotatably couple the utensil portion to the rod.

In an exemplary embodiment of the disclosure, the weight is connected to an end of the bowl and it extends downward below the bowl so that it can be leaned upon when loading food or content into the howl of the spoon. Alternatively, the weight is positioned on a side of the bowl. Optionally, the weight positioned on a side of the bowl is balanced with a second weight attached to the extension at the bottom end of the rod. Optionally, the second weight is positioned on the opposite side to balance the bowl around the axis of rotation of the rod.

In an exemplary embodiment of the disclosure, a locking mechanism protrudes from the rod and/or from the utensil portion to engage the weight and limit the downward motion of the handle portion. The locking mechanism helps to better position the bowl to load food or content into the bowl of the spoon.

There is thus provided according to an exemplary embodiment of the disclosure, a spoon, comprising:

- a handle portion and a utensil portion rotatably coupled to the handle portion;
- the handle portion comprising:
  - an elongated rod having a top end and a bottom end, wherein the elongated rod is rotatably coupled to the utensil portion at a the top end; and
  - a sleeve rotatably enclosing the elongated rod;

- the utensil portion comprising:
  - a bowl for transferring content; and
  - a weight for balancing the bowl;
- wherein the bowl is balanced to remain level in two orthogonal directions thus preventing spilling the content of the bowl during use of the spoon.

In an exemplary embodiment of the disclosure, the weight is attached under the bowl. Alternatively, the weight is attached on one side of the bowl; and further comprising a counter weight extending from near the bottom end or any other position along the elongated rod. Optionally, the weight and the counter weight have the same mass. Alternatively, the weight and the counter weight have a different mass.

In an exemplary embodiment of the disclosure, the elongated rod includes an arm extending from the top end perpendicularly to the elongated rod for rotatably coupling with the spoon portion. Optionally, the utensil portion includes wings for hanging the utensil portion from the arm. Alternatively, the elongated rod includes a looped head extending from the top end of the elongated rod for rotatably coupling with the spoon portion. Optionally, the utensil portion includes a shaft extending between two shoulders for rotatably coupling with the looped head. In an exemplary embodiment of the disclosure, the shaft has a truncated circular cross section for immovably locking itself between the shoulders of the utensil portion. Alternatively, the shaft has a polygonal cross section for immovably locking itself between the shoulders of the utensil portion.

In an exemplary embodiment of the disclosure, the spoon includes a locking mechanism to limit the rotation of the handle portion relative to the utensil portion. Optionally, the spoon includes a strap attached to the sleeve to couple the sleeve to user's hand. In an exemplary embodiment of the disclosure, the elongated rod is covered by an inner sleeve that rotatably accommodates the sleeve of the handle portion. Optionally, the inner sleeve is held in place by teeth that protrude along the length of the elongated rod.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1:
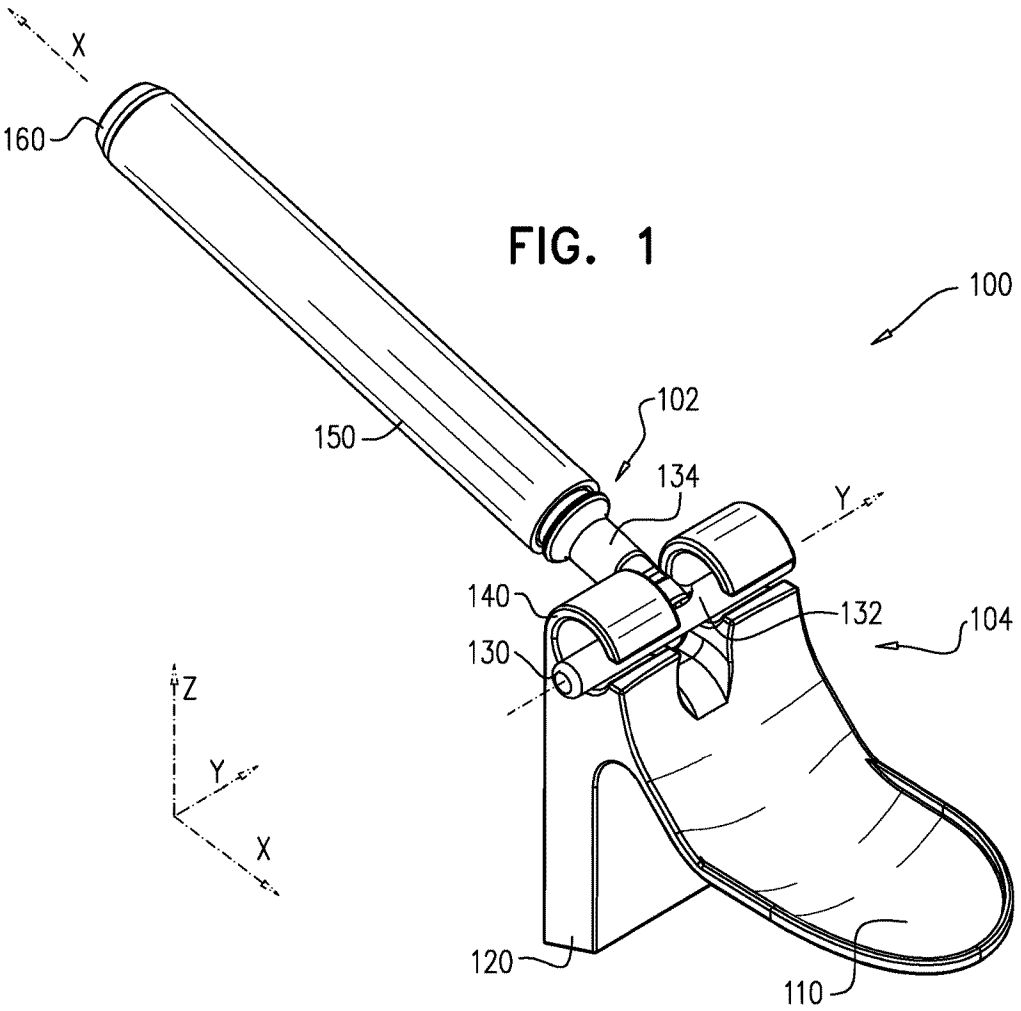
FIG. 1 is a schematic illustration of a perspective view of a spoon, according to an exemplary embodiment of the disclosure.

FIG. 1 is a schematic illustration of a perspective view of a spoon 100, according to an exemplary embodiment of the disclosure. In an exemplary embodiment of the disclosure spoon 100 is designed to remain level in two orthogonal directions (X, Y) while being moved around by a user. As shown in FIG. 1 spoon 100 includes a handle portion 102 that is made up from a screw 160 that is connected to a rod 130. In an exemplary embodiment of the disclosure, rod 130 is made up from an arm 132 and a connector 134 extending perpendicularly from arm 132 to connect with screw 160. Optionally, a sleeve 150 rotatably encloses screw 160 and connector 134 so that when grasped by a user rod 130 can be held steady while the user's hand rotates around an X axis that coincides with screw 160. In some embodiments of the disclosure, screw 160 may be short and connector 134 may be elongated or vice versa. Optionally, screw 160 may be replaced by a cover that is attached (e.g. by pressure, adhesively, using a connector or other means) to rod 130.

In an exemplary embodiment of the disclosure, a utensil portion 104 for transferring food is coupled to rod 130. Optionally, the utensil portion 104 includes wings 140 to rotatably hang from rod 130, so that the utensil portion 104 can rotate around a Y axis that coincides with arm 132. In some embodiments of the disclosure, the utensil portion 104 and the handle portion 102 are connected by other types of connectors as long as the utensil portion 104 can rotate around the Y axis that coincides with arm 132.

In an exemplary embodiment of the disclosure, utensil portion 104 includes a bowl 110 for accepting food and a weight 120 for balancing bowl 110 of utensil portion 104 and any content therein. In an exemplary embodiment of the disclosure, weight 120 extends downward from an end of bowl 110 and is positioned under wings 140 coupling utensil portion 104 to rod 130. Optionally, bowl 110, weight 120 and wings 140 are all part of a cast structure. Alternatively, each part is formed separately and connected together to form utensil portion 104.

Optionally, when a user holds sleeve 150 of handle portion 102 weight 120 will keep bowl 110 level facing upward even if the user's hand jerks about causing rotations around the X axis and/or the Y axis. Thus the user can transfer food upward or downward along the Z axis with non-smooth hand motions without the content of bowl 110 spilling out. Optionally, weight 120 is designed to be heavier than the food/content that will be handled by spoon 100.

Figure 2B:
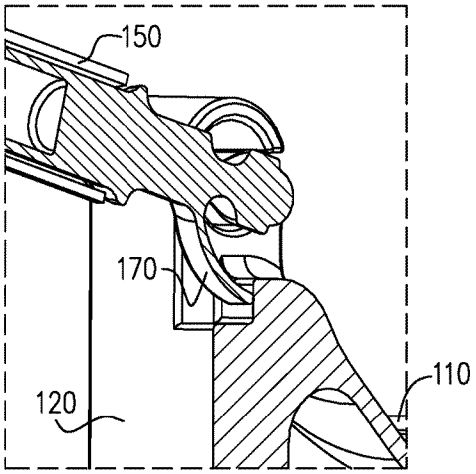
FIG. 2B is an enlarged cross sectional view of a locking mechanism of a spoon to assist in loading food from a plate, according to an exemplary embodiment of the disclosure.
Figure 2C:
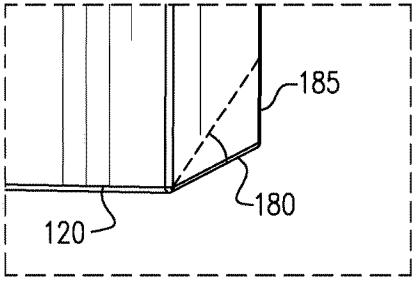
FIG. 2C is an enlarged view of a weight for balancing a spoon, according to an exemplary embodiment of the disclosure.
Figure 2A:
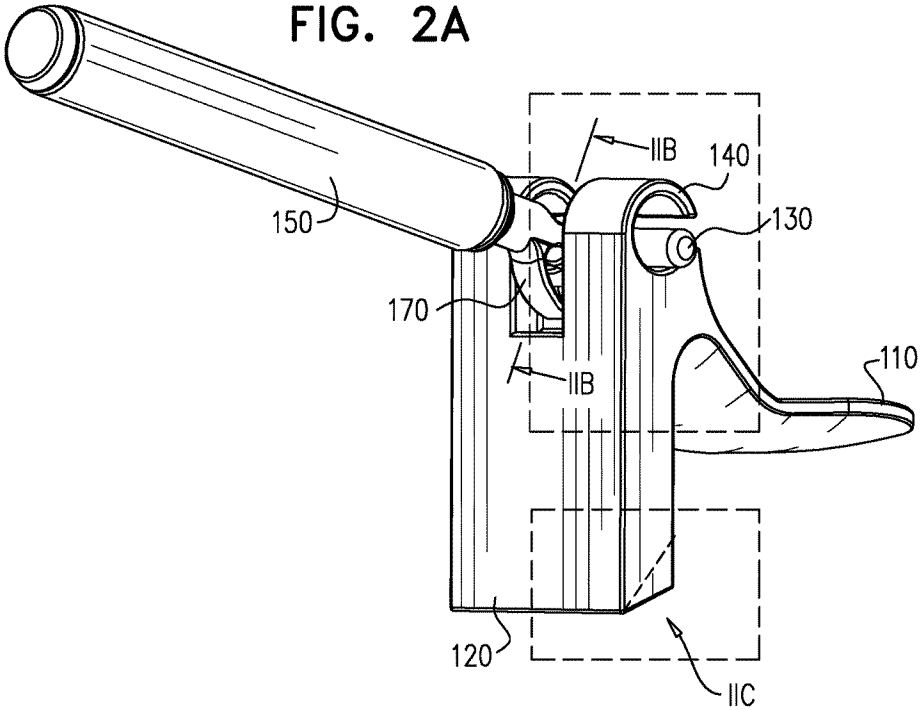
FIG. 2A is a schematic illustration of a spoon with a locking mechanism to assist in loading food from a plate, according to an exemplary embodiment of the disclosure.

FIG. 2A is a schematic illustration of a spoon 100 with a locking mechanism 170 to assist in loading food from a plate, and FIG. 2B is an enlarged cross sectional view of locking mechanism 170 of spoon 100 to assist in loading food from a plate, according to an exemplary embodiment of the disclosure. In an exemplary embodiment of the disclosure, locking mechanism 170 extends downward from connector 134 limiting the downward motion of handle portion 102. Optionally, if the user moves handle portion 102 downward by a predetermined amount locking mechanism 170 will form contact with weight 120 and push it forward along the X axis instead of remaining stationary. FIG. 2C is an enlarged view of weight 120 for balancing spoon 100, according to an exemplary embodiment of the disclosure. Optionally, weight 120 is designed to extend during use of spoon 100 below bowl 110, so that when spoon 100 is lowered onto a surface 190 a base 180 of weight 120 will form contact with the surface 190 (e.g. a table or a plate) and spoon 100 will be pushed forward alone the X axis while handle portion 102 is lowered. In some embodiments of the disclosure base 180 forms a right angle with surface 190, so that it stands upright with bowl 110 extending forward above the surface. Alternatively, base 180 forms an acute angle 185 with surface 190 causing weight 120 to tilt relative to surface 190, so that bowl 110 will tilt downward for example into the plate to load food into it.

Figures 3A, 3B, 3C:
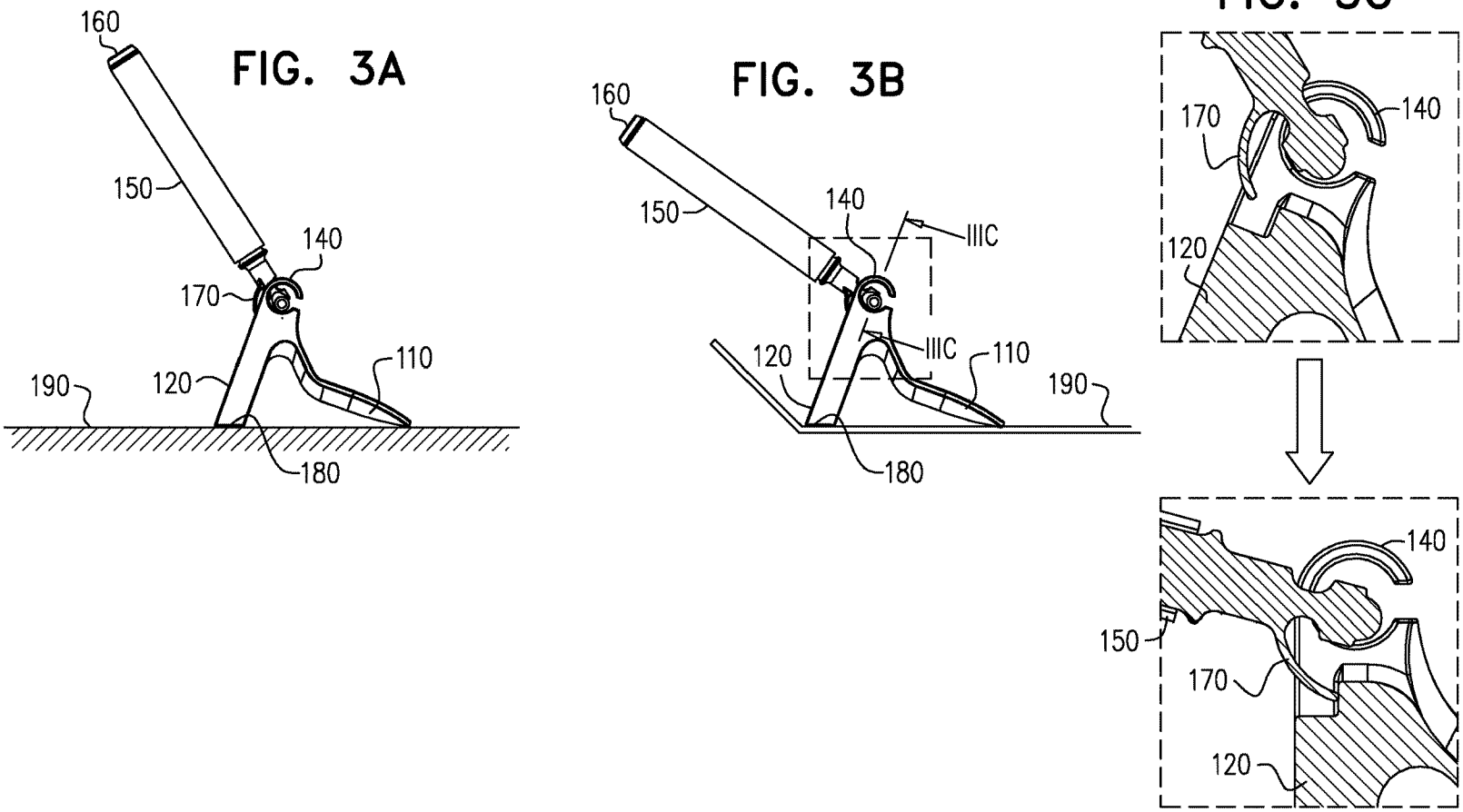
FIG. 3A is a schematic illustration of a spoon with a base of a weight forming contact with a surface, according to an exemplary embodiment of the disclosure.
FIG. 3B is a schematic illustration of a spoon resting on a base of a weight, according to an exemplary embodiment of the disclosure.
FIG. 3C is a cross sectional view of a spoon resting on a base of a weight, according to an exemplary embodiment of the disclosure.

FIG. 3A is a schematic illustration of spoon 100 with base 180 of weight 120 forming contact with surface 190; FIG. 3B is a schematic illustration of spoon 100 resting on base 180 of weight 120, according to an exemplary embodiment of the disclosure; and FIG. 3C is a cross sectional view of a spoon 100 resting on base 180 of weight 120, according to an exemplary embodiment of the disclosure.

As illustrated in FIGS. 3A-3C when spoon 100 is lowered onto surface 190 weight 120 tilts forward according to angle 185 of base 180 (FIG. 2C) causing bowl 110 of spoon 100 to lean forward at angle 185 so that it can accept food into bowl 110. Optionally, if the user continues to lower handle portion 102 of spoon 100 downward along the Z axis locking mechanism 170 pushes it forward on surface 190 for loading food. In an exemplary embodiment of the disclosure, when the user lifts handle portion 102 bowl 110 is lifted up while staying level in the directions of the X and Y axis so that the content of bowl 110 will not spill.

Figure 4:
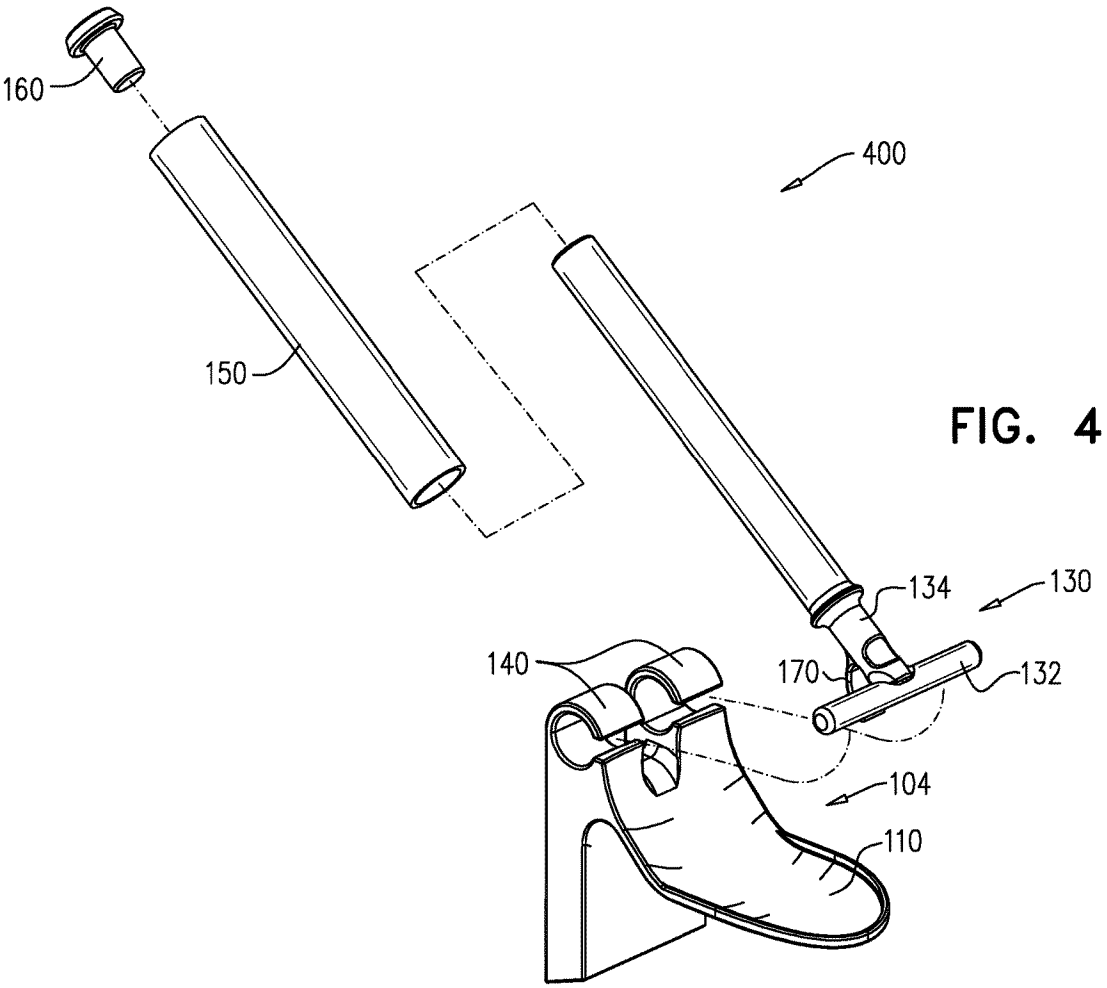
FIG. 4 is a schematic illustration of an exploded view of elements for assembling a spoon, according to an exemplary embodiment of the disclosure.

FIG. 4 is a schematic illustration of an exploded view of elements 400 for assembling spoon 100, according to an exemplary embodiment of the disclosure. In FIG. 4 rod 130 is shown with an elongated connector 134 on which sleeve 150 is deployed. Optionally, screw 160 includes a wide screw head to keep sleeve 150 from coming off. As mentioned above screw 160 may be elongated and connector 134 may be short as long as together sleeve 150 is held in place and can rotate around the combination of connector 134 and screw 160 coupled together without sliding off.

Figure 5:
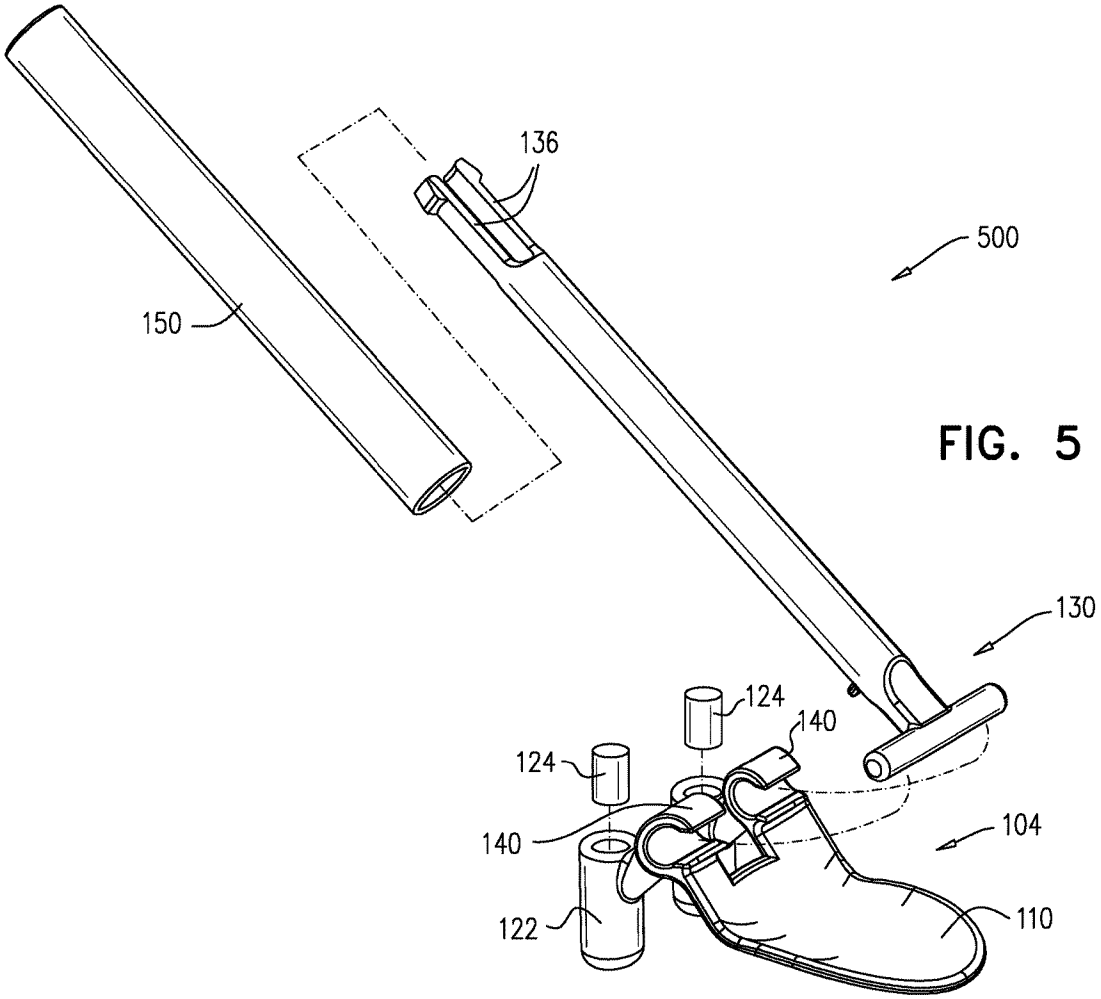
FIG. 5 is a schematic illustration of alternative elements for assembling a spoon, according to an exemplary embodiment of the disclosure.

FIG. 5 is a schematic illustration of alternative elements 500 for assembling spoon 100, according to an exemplary embodiment of the disclosure. In the embodiment disclosed in FIG. 5 connector 134 includes clips 136 at the end to hold sleeve 150 in place instead of sealing the end with screw 160.

In an exemplary embodiment of the disclosure, weight 120 comprises multiple weight units that are attached to balance utensil portion 104. Optionally, each weight unit includes a weight housing 122 filled with a heavy material 124 to weigh it down. For example the heavy material 124 may be a metal rod, sand, a rock or any other material with a large specific gravity.

Figure 6:
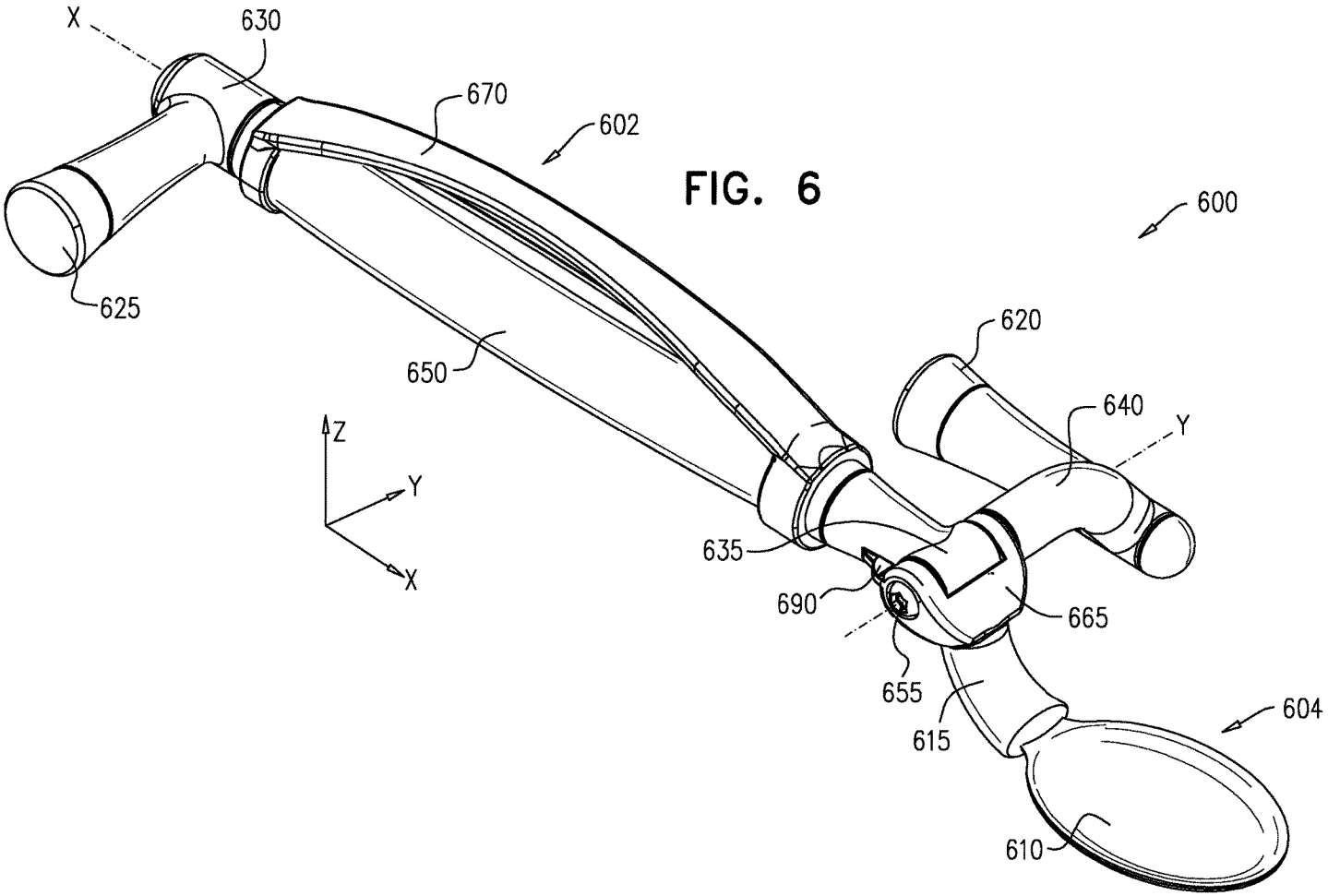
FIG. 6 is a schematic illustration of an alternative spoon, according to an exemplary embodiment of the disclosure.
Figure 7:
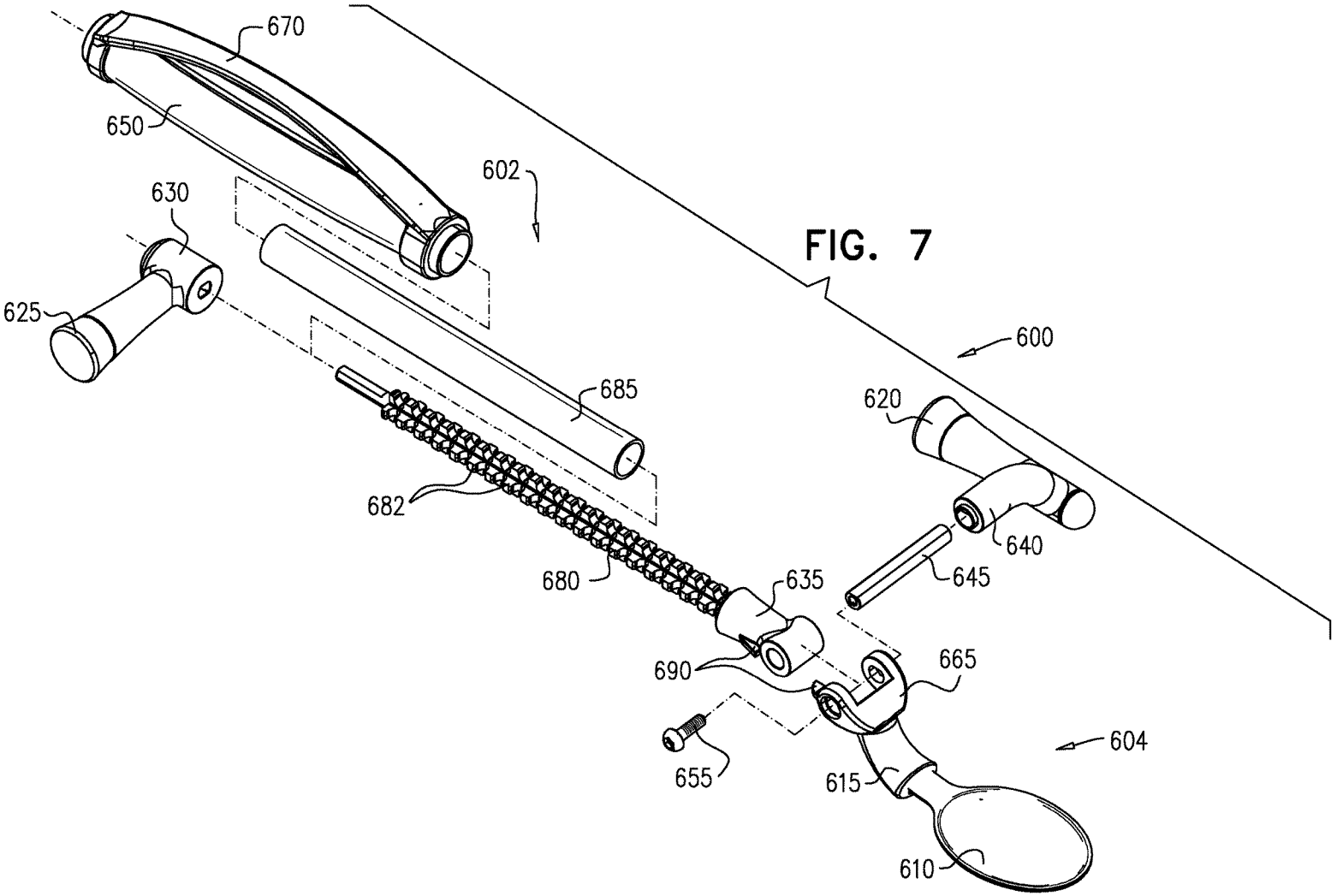
FIG. 7 is a schematic illustration of an exploded view of elements for assembling an alternative spoon, according to an exemplary embodiment of the disclosure.

FIG. 6 is a schematic illustration of an alternative spoon 600, according to an exemplary embodiment of the disclosure; and FIG. 7 is a schematic illustration of an exploded view of elements for assembling alternative spoon 600, according to an exemplary embodiment of the disclosure. In an exemplary embodiment of the disclosure, spoon 600 in as similar manner as spoon 100 also includes a utensil portion 604 and a handle portion 602. As with spoon 100 the utensil portion 604 is rotatably attached to the handle portion 602, so that it is free to rotate around the Y axis (perpendicular to the handle portion). The handle portion is designed to be grasped by the user's hand while maintaining the utensil portion free to rotate about the X axis (parallel to the handle portion), so that the spoon 600 is capable of rotating in two orthogonal directions (X, Y) while being lifted or lowered by the user along the Z axis. Accordingly, by using weights to maintain equilibrium the spoon can be jerked about (e.g. tilted, lifted, lowered, pushed and pulled) without dropping its content.

In an exemplary embodiment of the disclosure, spoon 600 includes a bowl 610 for holding food or other content. Optionally, bowl 610 is connected to a body 615 having two shoulders 665 extending from body 615. The shoulders 665 enable rotatably coupling between the utensil portion 604 and the handle portion 602.

In an exemplary embodiment of the disclosure, a shaft 645 is supported by shoulders 665 to rotatably couple the handle portion 602 with the utensil portion 604. Optionally, shaft 645 has a semicircular cross section or truncated circular cross section to couple to shoulders 665 by immovably locking itself between the shoulders 665 while allowing the handle portion 602 to rotate relative to the shoulders 665. In some embodiments of the disclosure, shaft 645 has a polygonal cross section, for example hexagonal, pentagonal or octagonal. Alternatively, shaft 645 is circular and locked in place by friction or by a screw. In an exemplary embodiment of the disclosure, the shaft 645 is connected on one side to a balancing interface 640 with a weight 620 at an end of the balancing interface 640. Optionally, the other side of shaft 645 is closed with a screw to prevent it from sliding out of shoulders 665. In an exemplary embodiment of the disclosure, weight 620 balances bowl 610 with its content around the Y axis and also balances around the X axis as explained below.

In an exemplary embodiment of the disclosure, handle portion 602 includes a central rod 680 having a looped bead 635 to rotatably grasp shaft 645. Alternatively, utensil portion 604 may include the looped head and handle portion 602 may include the shaft to rotatably couple them together.

Optionally, central rod 680 is covered with teeth 682 to frictionly interface with an inner cylindrical sleeve 685 that is used to cover central rod 680. Alternatively, inner cylindrical sleeve 685 may serve as a protective cover that rotates around central rod 680 and may interface with other elements that are attached to it as described below. In an exemplary embodiment of the disclosure, an interface 630 is attached to the outer end of central rod 680 (opposite looped head 635). Optionally, interface 630 is coupled to a weight 625 that serves as a balance with weight 620 around the X axis. In an exemplary embodiment of the disclosure, both weights have the same mass. Alternatively, weight 620 and weight 625 have a different mass and balance each other by their position relative to the X axis and/or the Y axis through the central rod 680. In some embodiments of the disclosure, interface 630 extends from other positions along central rod 680, for example the center or top instead of from the bottom/outer end.

In an exemplary embodiment of the disclosure, an outer sleeve 650 is inserted over inner sleeve 685. Optionally, a strap 670 is attached to outer sleeve 650. In an exemplary embodiment of the disclosure, a user grasps outer sleeve 650, for example by inserting his or her hand between strap 670 and outer sleeve 650 while grasping outer sleeve 650. Optionally, outer sleeve 650 provides central rod 680 with the freedom to rotate around the X axis. In an exemplary embodiment of the disclosure, outer sleeve 650 is covered with a soft material such as a sponge or soft plastic to provide a soft feel for the user. Optionally, strap 670 is made from an elastic material to gently exert pressure on the user's hand and to accommodate various hand sizes. The strap 670 prevents the user from dropping the spoon 600. In some embodiments of the disclosure, outer sleeve 650 is attached to inner cylindrical sleeve 685 to rotate together, for example outer sleeve 650 may be made from a soft plastic and inner cylindrical sleeve 685 may be made from metal.

In an exemplary embodiment of the disclosure, looped head 635 and shoulders 665 include a locking mechanism 690 in the form of protrusions from looped head 635 and shoulders 665. Optionally, locking mechanism 690 limits the motion of handle portion 602 relative to utensil portion 604, for example only enabling handle portion 602 to rotate 90 degrees or 180 degrees around shaft 645 relative to utensil portion 604.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure. It will also be appreciated by persons skilled in the art that the present disclosure is not limited to what has been particularly shown and described hereinabove.

I claim:

1. A spoon, comprising:

a handle portion and a utensil portion rotatably coupled to the handle portion;

the handle portion comprising:

an elongated rod having a top end and a bottom end, wherein the elongated rod is rotatably coupled to the utensil portion at the top end, to allow a rotation perpendicular to the handle portion; and a sleeve rotatably enclosing the elongated rod, to allow a rotation parallel to the handle portion;

the utensil portion comprising: a bowl for transferring content; and the spoon further comprising:

a weight for balancing the bowl, the weight external to the bowl attached on one side of the bowl;

a balancing interface;

a counter weight external to the bowl on an opposite side of the bowl extending from near the bottom end or any other position along the elongated rod or of the utensil portion, the counter weight being separate from the weight, wherein the bowl is balanced to remain level in two orthogonal directions thus preventing spilling the content of the bowl during use of the spoon, and wherein the balancing interface is connected on one side to the weight and on a second side to a body having two shoulders, and wherein the balancing interface positions the weight in a plane offset from a plane of the elongated rod.

2. A spoon according to claim 1, wherein the weight and the counter weight have the same mass.

3. A spoon according to claim 1, wherein the weight and the counter weight have a different mass.

4. A spoon according to claim 1, wherein the elongated rod includes an arm extending from the top end perpendicularly to the elongated rod for rotatably coupling with the utensil portion.

5. A spoon according to claim 4, wherein the utensil portion includes shoulders for hanging the utensil portion from the arm.

6. A spoon according to claim 1, wherein the elongated rod includes a looped head extending from the top end of the elongated rod for rotatably coupling with the utensil portion.

7. A spoon according to claim 6, wherein the utensil portion includes a shaft extending between two shoulders for rotatably coupling with the looped head.

8. A spoon according to claim 7, wherein the shaft has a truncated circular cross section for immovably locking the shaft between the shoulders of the utensil portion.

9. A spoon according to claim 7, wherein the shaft has a polygonal cross section for immovably locking the shaft between the shoulders of the utensil portion.

10. A spoon according to claim 1, further comprising a locking mechanism to limit the rotation of the handle portion relative to the utensil portion.

11. A spoon according to claim 1, further comprising a strap attached to the sleeve to couple the sleeve to user's hand.

12. A spoon according to claim 1, wherein the elongated rod is covered by an inner sleeve that rotatably accommodates the sleeve of the handle portion.

13. A spoon according to claim 12, wherein the inner sleeve is held in place by teeth that protrude along the length of the elongated rod.

14. A spoon according to claim 1, wherein the body having two shoulders is connected to the bowl.

* * * * *